US009318036B2

(12) United States Patent
Park et al.

(10) Patent No.: US 9,318,036 B2
(45) Date of Patent: Apr. 19, 2016

(54) METHOD OF COMPENSATING IMAGE DATA AND DISPLAY APPARATUS FOR PERFORMING THE SAME

(71) Applicant: Samsung Display Co., Ltd., Yongin, Gyeonggi-Do (KR)

(72) Inventors: Bong-Im Park, Asan-si (KR); Jun-Pyo Lee, Asan-si (KR); Ik-Huyn Ahn, Asan-si (KR); Ho-Seok Son, Incheon (KR); Kang-Min Kim, Seoul (KR); Jung-Won Kim, Seoul (KR); Seon-Ki Kim, Anyang-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 187 days.

(21) Appl. No.: 14/107,551

(22) Filed: Dec. 16, 2013

(65) Prior Publication Data

US 2014/0104265 A1 Apr. 17, 2014

Related U.S. Application Data

(63) Continuation of application No. 12/969,791, filed on Dec. 16, 2010, now Pat. No. 9,019,193.

(30) Foreign Application Priority Data

May 11, 2010 (KR) ..... 10-2010-0043724

(51) Int. Cl.
*G09G 3/20* (2006.01)
*G09G 3/36* (2006.01)

(52) U.S. Cl.
CPC ..... *G09G 3/20* (2013.01); *G09G 3/3648* (2013.01); *G09G 2320/0252* (2013.01); *G09G 2320/0261* (2013.01); *G09G 2320/0285* (2013.01); *G09G 2320/041* (2013.01); *G09G 2340/16* (2013.01)

(58) Field of Classification Search
CPC ..... G09G 2340/041; G09G 2320/0666; H04N 1/00814; H04N 9/73
See application file for complete search history.

(56) References Cited

U.S. PATENT DOCUMENTS 7,688,304 B2 3/2010 Park
8,081,154 B2 * 12/2011 Kondoh ..... G09G 3/3629 345/101

(Continued)

FOREIGN PATENT DOCUMENTS

CN 1906656 A 1/2007
EP 1521237 A2 4/2005

(Continued)

OTHER PUBLICATIONS

Extended European Search Report for Application No. 11000919.8-2205 dated Sep. 1, 2011.

(Continued)

*Primary Examiner* — Antonio A Caschera
(74) *Attorney, Agent, or Firm* — Cantor Colburn LLP

(57) ABSTRACT

A method of compensating image data, the method includes generating a compensation data of an image data in accordance with a temperature value by using a compensation data of a previous frame and a compensation data generated through a look-up table which is mapped with corresponding to a compensation data of a previous frame and a set temperature value which is smaller than and closest to the temperature value or which is greater than and closest to the temperature value among set temperature values.

14 Claims, 15 Drawing Sheets

(56) References Cited

U.S. PATENT DOCUMENTS

| | | | |
|---|---|---|---|
| 2003/0098839 | A1 | 5/2003 | Lee |
| 2006/0181503 | A1 | 8/2006 | Feng |
| 2007/0075951 | A1 | 4/2007 | Lin et al. |
| 2008/0284775 | A1 | 11/2008 | Shen et al. |

FOREIGN PATENT DOCUMENTS

| | | | |
|---|---|---|---|
| EP | 1521237 | A3 | 7/2007 |
| EP | 1879173 | A1 | 1/2008 |
| JP | 2001331154 | A | 11/2001 |
| JP | 2006065294 | A | 3/2006 |
| KR | 1020050047626 | A | 5/2005 |
| KR | 100672654 | B1 | 1/2007 |
| KR | 1020080001135 | A | 1/2008 |
| KR | 1020080072435 | A | 8/2008 |
| WO | 03098588 | A1 | 11/2003 |

OTHER PUBLICATIONS

Partial European Search Report for Application No. 11000919.8-2205 dated Jun. 20, 2011.

European Office Action for Application No. 11 000 919.8-2205 dated Aug. 13, 2012.

Extended European Search Report for Application No. 15188453.3-1904 dated Dec. 11, 2015.

* cited by examiner

FIG. 2

| TEMPERATURE VALUE(t) | SET TEMPERATURE VALUE(T) | LOOK-UP TABLE(LUT) |
|---|---|---|
| 0 °C | T1 | LUT1 |
| 10 °C | T2 | LUT2 |
| 20 °C | T3 | LUT3 |
| 30 °C | T4 | LUT4 |
| 40 °C | T5 | LUT5 |
| 50 °C | T6 | LUT6 |
| 60 °C | T7 | LUT7 |
| 70 °C | T8 | LUT8 |

<SET TEMPERATURE VALUE:10°C>

METHOD OF COMPENSATING IMAGE DATA AND DISPLAY APPARATUS FOR PERFORMING THE SAME

This application is a continuation of U.S. application Ser. No. 12/969,791, filed on Dec. 16, 2010, which claims priority to Korean Patent Application No. 2010-43724, filed on May 11, 2010, and all benefits accruing therefrom under 35 U.S.C. §119, the content of which in its entirety is herein incorporated by reference.

BACKGROUND OF THE INVENTION

1. Field of the Invention

Exemplary embodiments of the present invention generally relate to a method of compensating image data and a display apparatus for performing the same. More particularly, exemplary embodiments of the present invention relate to a method of compensating image data used in a liquid crystal display apparatus and a display apparatus for performing the method.

2. Description of the Related Art

Generally, a liquid crystal display ("LCD") apparatus includes an LCD panel and a light source apparatus which provides the LCD panel with light. The LCD panel typically includes an array substrate, an opposite substrate and a liquid crystal layer interposed between the array substrate and the opposite substrate. The liquid crystal layer includes liquid crystal molecules which have a physical characteristic such that they may alter the polarization of light passing therethrough. When an electric field is applied to the liquid crystal molecules, an arrangement of the liquid crystal molecules is altered, thereby also altering the orientation of their polarization directions. When the arrangement of the liquid crystal molecule is altered, a transmittance of light is altered in accordance with the arrangement of liquid crystal molecule so that image is displayed.

In order to minimize distortion of an image due to a temperature of an LCD panel, a dynamic capacitance compensation ("DCC") technology has been developed for use in LCDs. In the DCC technology, a current frame data is compensated using a previous frame data to substantially enhance a response speed of liquid crystal molecules to alter their orientation in response to an applied voltage differential.

For example, when a gradation data of a current frame is greater than that of a previous frame, the gradation data of the current frame is over driven to a higher gradation rather than the gradation data of the current frame to substantially enhance a rising response speed of the liquid crystal molecules. When a gradation data of a current frame is smaller than that of a previous frame, the gradation data of the current frame under driven to a lower gradation rather than the gradation data of the current frame to substantially enhance a falling response speed of the liquid crystal molecules.

BRIEF SUMMARY OF THE INVENTION

Exemplary embodiments of the present invention provide a method of compensating image data for enhancing quality of a display image.

Exemplary embodiments of the present invention also provide a display apparatus for performing the above-mentioned method.

According to one aspect of the present invention, there is provided an exemplary embodiment of a method of compensating image data. In the exemplary embodiment of the method, a compensation data of an image data is generated in accordance with a temperature value using a compensation data generated through a look-up table ("LUT") that is mapped corresponding to a compensation data of a previous frame and a set temperature value which is smaller than and closest to the temperature value or which is greater than and closest to the temperature value.

According to another aspect of the present invention, there is provided an exemplary embodiment of a method of compensating image data. In the exemplary embodiment of the method, a compensation data is generated in accordance with positions of an image data using a plurality of LUTs mapped corresponding to a plurality of space areas of a display panel.

According to still another aspect of the present invention, there is provided an exemplary embodiment of a method of compensating image data. In the exemplary embodiment of the method, a compensation data according to a position of an image data is generated using a plurality of LUTs mapped corresponding to a plurality of space areas of a display panel in accordance with a temperature.

According to still another aspect of the present invention, an exemplary embodiment of a display apparatus includes a display panel, a data compensating part and a data driving part. The display panel includes a plurality of pixels. The data compensating part generates a compensation data of an image data in accordance with a temperature value using a compensation data generated through an LUT that is mapped corresponding to a compensation data of a previous frame and a set temperature value which is smaller than and closest to the temperature value or which is greater than and closest to the temperature value. The data driving part drives the display panel using the compensation data.

According to still another aspect of the present invention, an exemplary embodiment of a display apparatus includes a display panel, a data compensating part and a data driving part. The display panel includes a plurality of pixels. The data compensating part generates a compensation data in accordance with positions of an image data using a plurality of LUTs mapped corresponding to a plurality of space areas of the display panel. The data driving part drives the display panel using the compensation data.

According to still another aspect of the present invention, an exemplary embodiment of a display apparatus includes a display panel, a data compensating part and a data driving part. The display panel includes a plurality of pixels. The data compensating part generates a compensation data according to a position of an image data using a plurality of LUTs mapped corresponding to a plurality of space areas of the display panel in accordance with a temperature. The data driving part drives the display panel using the compensation data.

In some exemplary embodiments of the present invention, compensation data different from each other are generated in accordance with positions of a display panel, so that display quality may be substantially enhanced. Moreover, compensation data different from each other are generated in accordance with a temperature of the display panel which minutely increases or decreases, so that display quality may be substantially enhanced.

BRIEF DESCRIPTION OF THE DRAWINGS

The above and other features and advantages of the present invention will become more apparent by describing in detailed exemplary embodiments thereof with reference to the accompanying drawings, in which:

FIG. 2 is a concept diagram showing an exemplary embodiment of a look-up table ("LUT") storing part of FIG. 1;

DETAILED DESCRIPTION OF THE INVENTION

Figure 1:
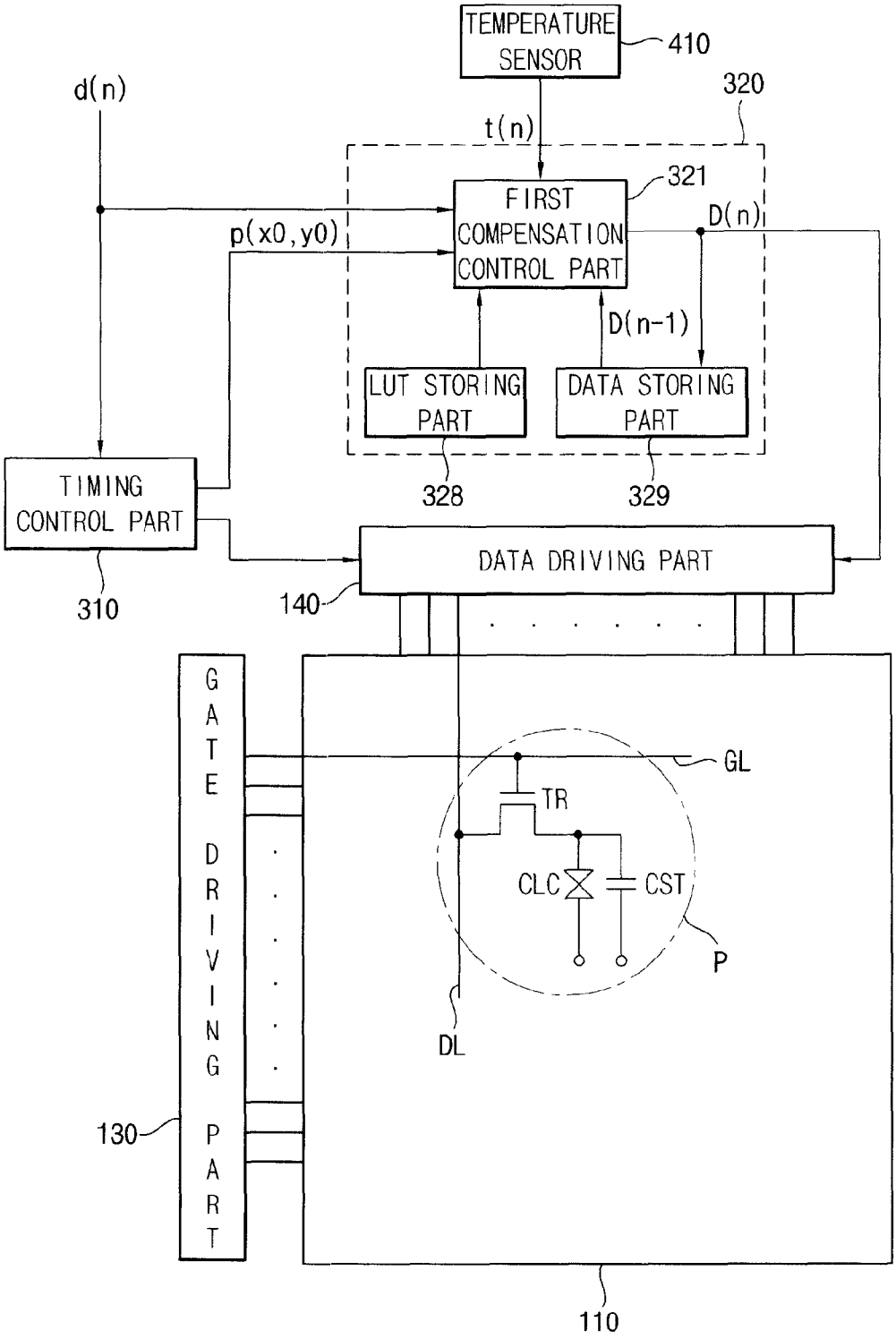
FIG. 1 is a block diagram showing an exemplary embodiment of a display apparatus according the present invention.

The present invention is described more fully hereinafter with reference to the accompanying drawings, in which example embodiments of the present invention are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art. In the drawings, the sizes and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments of the invention are described herein with reference to cross-sectional illustrations that are schematic illustrations of idealized example embodiments (and intermediate structures) of the present invention. As such, variations from the shapes of the illustrations as a result, for example, of manufacturing techniques and/or tolerances, are to be expected. Thus, example embodiments of the present invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings.

FIG. 1 is a block diagram showing an exemplary embodiment of a display apparatus according to the present invention. FIG. 2 is a concept diagram showing an exemplary embodiment of a look-up table ("LUT") storing part shown in FIG. 1.

Referring to FIG. 1, the display apparatus includes a display panel 110, a timing control part 310, a gate driving part 130, a data compensating part 320, a data driving part 140 and a temperature sensor 410.

An exemplary embodiment of the display panel 110 includes a display area DA in which a plurality of pixels P is formed and a peripheral area PA surrounding the display area DA. Each of the pixels P includes a pixel transistor TR connected to a data line DL and a gate line GL, a liquid crystal capacitor CLC connected to the pixel transistor TR, and a storage capacitor CST connected to the pixel transistor TR. The gate driving part 130 generates a gate signal which will be provided to the gate line GL and is formed at the peripheral area PA of the display panel 110. In one exemplary embodiment, the gate driving part 130 may include a plurality of circuit transistors, and the plurality of circuit transistors may be formed at substantially the same time as the pixel transistor. In another exemplary embodiment, the gate driving part 130 may be connected to the display panel 110 through a tape carrier package ("TCP") method in which the gate driving chip is mounted thereon. In still another example, the gate driving part 130 may be mounted on the peripheral area PA of the display panel 110 through a chip on glass ("COG") method in which a gate driving chip is directly mounted on the peripheral area PA. Alternative exemplary embodiments include additional alternative configurations of the gate driving part 130.

The timing control part 310 receives an image data d(n) of an n-th frame to provide the data compensating part 320 with a position data p(x0,y0) of the image data d(n). In this case, 'n' is a natural number. Moreover, the timing control part 310 controls a driving timing of the gate driving part 130 and the data driving part 140. The image data d(n) is a gray-scaled value of the n-th frame, and the position data p(x0,y0) is a position coordinate of a pixel corresponding to the image data d(n) positioned on the display panel 110.

The data compensating part 320 includes a first compensation control part 321, an LUT storing part 328 and a data storing part 329.

The first control part 321 compensates the image data d(n) based on a temperature value t(n) measured by the temperature sensor 410.

The LUT storing part 328 stores a plurality of look-up tables LUT1, . . . , LUTm, LUTm+1, . . . , LUTk mapped corresponding to set temperature values T1, . . . , Tm, Tm+1, . . . , Tk. In this case, 'm' and 'k' are natural numbers.

In one exemplary embodiment, as shown in FIG. 2, the LUT storing part 328 set first to eighth set temperature values T1 to T8 corresponding to a temperature value t measured by the temperature sensor 410, and stores first to eighth look-up tables LUT1 to LUT8 mapped corresponding to the temperature values T1 to T8.

The data storing part 329 stores a compensation data compensated by the first compensation control part 321. For example, when an image data d(n) of an n-th frame is compensated by the first compensation control part 321, the data compensating part 329 may store a compensation data D(n−1) of an (n−1)-th frame previous to the n-th frame.

The first compensation control part 321 determines a set temperature value T corresponding to the temperature value t, and the first compensation control part 321 generates a compensation data D(n) of the image data d(n) using a look-up table LUT mapped corresponding to the set temperature value T stored in the LUT storing part 328. Specifically, the first compensation control part 321 receives the temperature value t(n) measured from a temperature sensor 410, or alternatively measures the temperature value t(n) internally, and then selects one of the set temperature values, e.g., T1 to T8, which is smaller than and closest to the measured temperature value t(n) or which is greater and closest to the measured temperature value t(n).

When the set temperature value T corresponding to the temperature value t does not exist and the temperature value t is between an m-th set temperature value Tm and an (m+1)-th set temperature value Tm+1, the first compensation control part 321 generates a compensation data D(n) of the image data d(n) using a compensation data D(n−1) of an (n−1)-th frame stored in the data storing part 329, a compensation data generated through an m-th look-up table LUTm mapped corresponding to an m-th set temperature value Tm, and a compensation data generated through an (m+1)-th look-up table LUTm+1 mapped corresponding to an (m+1)-th set temperature value Tm+1. In the present exemplary embodiment, 'm' is a natural number.

The data driving part 140 converts the compensation data D(n) compensated at the data compensating part 320 into an analog data voltage, and provides the display panel 110 with the analog data voltage.

When the display apparatus is used in a television ("TV") set, the temperature sensor 410 may be mounted on an additional circuit board. In one exemplary embodiment, when the display apparatus is used in a liquid crystal display ("LCD") module, the temperature sensor 410 may be mounted on the display panel 110. When the temperature sensor 410 is mounted on the display panel 110, the temperature sensor 410 may be formed on a peripheral area PA of the display panel 110 in a manufacturing process substantially identical to a manufacturing process of the pixel transistor TR formed on the display area DA.

Figure 3:
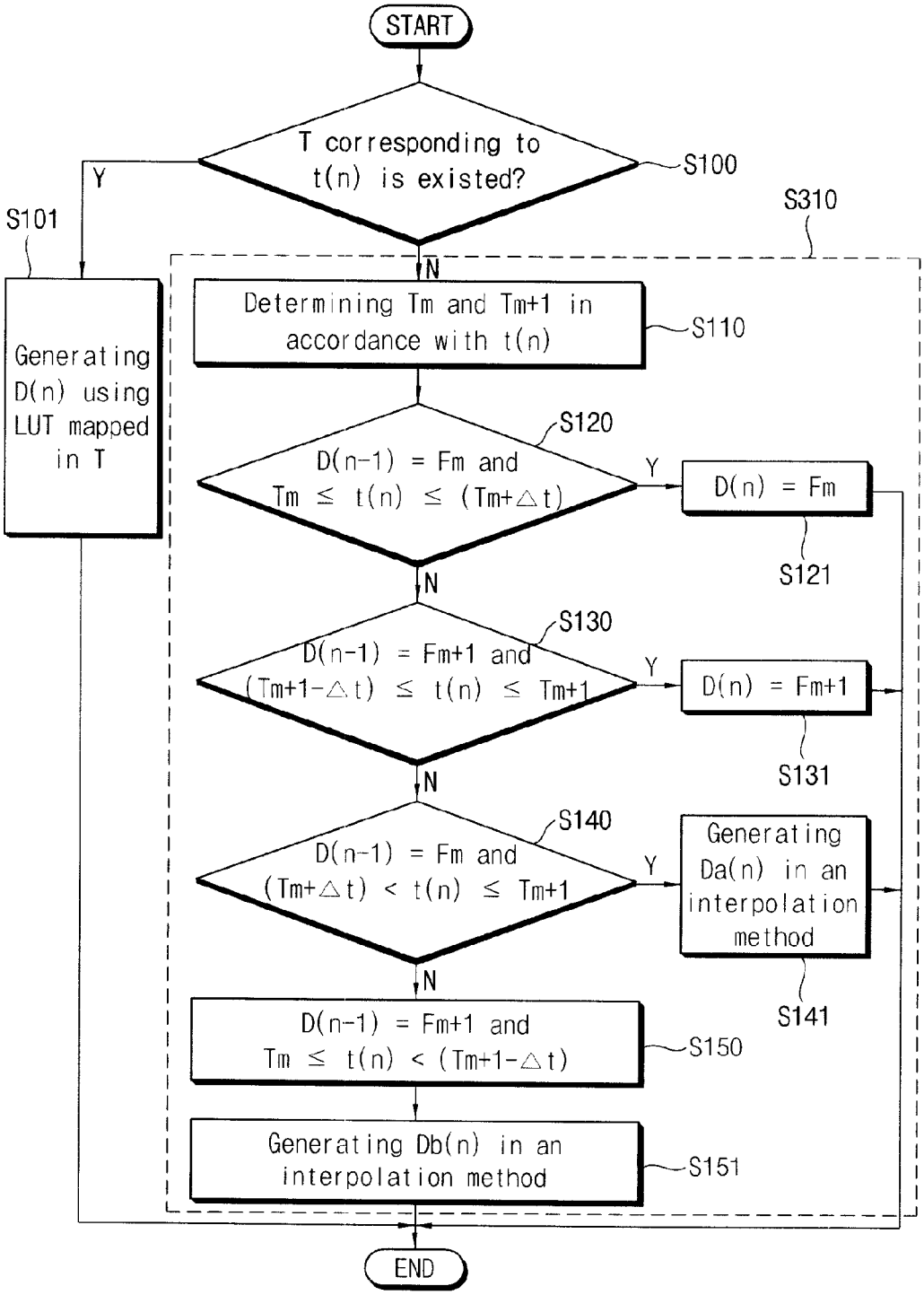
FIG. 3 is a flowchart showing an exemplary embodiment of a driving method of a data compensating part of FIG. 1.
Figure 4:
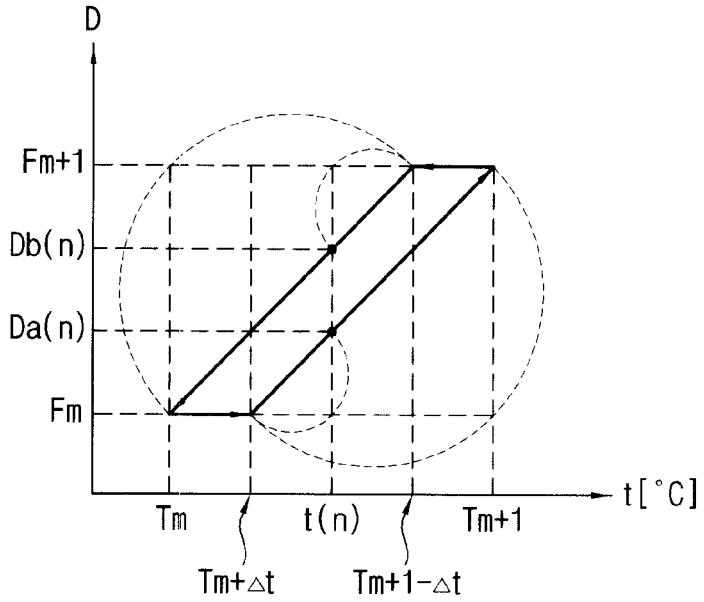
FIG. 4 is a concept diagram showing an exemplary embodiment of a driving method of the data compensating part of FIG. 1.

FIG. 3 is a flowchart showing an exemplary embodiment of a driving method of a data compensating part 320 shown in FIG. 1. FIG. 4 is a concept diagram showing an exemplary embodiment of a driving method of the data compensating part 320 of FIG. 1.

Referring to FIGS. 1 to 4, the first compensation control part 321 receives a temperature value t(n). The first compensation control part 321 checks whether a set temperature value T(n) corresponding to the temperature value t(n) exists or not (step S100). When it is determined that a set temperature value T(n) corresponding to the temperature value t(n) exists, the first compensation control part 321 compensates an image data d(n) of an n-th frame received using a look-up table mapped corresponding to the set temperature value T(n) (step S101). That is, the first compensation control part 321 generates a compensation data D(n) of the n-th frame using a compensation data D(n−1) stored in the data storing part 329 corresponding to the position data p(x0,y0) of the image data d(n).

When it is determined that the set temperature value T(n) corresponding to the temperature value t(n) does not exist (step S100), the first compensation control part 321 compensates the image data d(n) using a compensation data D(n−1) of an (n−1)-th frame corresponding to the image data d(n) (step S310). That is, if the measured temperature value t(n) is not within the range of the set temperature values T(n), the first compensation control part 321 compensates the image data d(n) using a compensation data D(n−1) of an (n−1)-th frame corresponding to the image data d(n) (step S310).

For example, in one exemplary embodiment the first compensation control part 321 may determine that the temperature value t(n) is bound by an m-th set temperature value Tm and an (m+1)-th set temperature value Tm+1 (step S110).

When it is determined that a compensation data D(n−1) of an (n−1)-th frame is a compensation data Fm generated through an m-th look-up table LUTm mapped corresponding to the m-th set temperature value Tm and the temperature value t(n) exists between the m-th set temperature value Tm and a first permissive temperature value (Tm+Δt) (step S120), the first compensation control part 321 determines a compensation data D(n) of the image data d(n) to be the compensation data Fm that is a compensation data D(n−1) of an (n−1)-th frame (step S121).

When it is determined that a compensation data D(n−1) of an (n−1)-th frame is a compensation data Fm+1 generated through an (m+1)-th look-up table LUTm+1 mapped corresponding to the (m+1)-th set temperature value Tm+1 and the temperature value t(n) exists between a second permissive temperature value (Tm+1−Δt) and the (m+1)-th set temperature value Tm+1 (step S130), the first compensation control part 321 determines a compensation data D(n) of the image data d(n) to be the compensation data Fm+11 that is a compensation data D(n−1) of an (n−1)-th frame (step S131).

When it is determined that a compensation data D(n−1) of an (n−1)-th frame is a compensation data Fm and the temperature value t(n) exists between the first permissive temperature value (Tm+Δt) and the (m+1)-th set temperature value Tm+11 (step S140), the first compensation control part 321 calculates a compensation data Da(n) of the image data d(n) using a compensation data Fm of the (n−1)-th frame and the compensation data Fm+1 corresponding to the (m+1)-th set temperature value Tm+1 greater than and closest to the temperature value t(n) using a linear interpolation method (step S141). The compensation data Da(n) may be calculated using a linear interpolation method as following Equation 1.

$$\frac{(F_{m+1}-F_m)}{(T_{m+1}-T_m-\Delta t)}=\frac{Da(n)-F_m}{t(n)-T_m-\Delta t} \quad \text{⟨Equation 1⟩}$$

$$Da(n)=F_m+\frac{t(n)-T_m-\Delta t}{T_{m+1}-T_m-\Delta t}(F_{m+1}-F_m)$$

When it is determined that a compensation data D(n−1) of an (n−1)-th frame is the compensation data Fm+1 and the temperature value t(n) exists between the m-th set temperature value Tm and the second permissive temperature value (Tm+1−Δt) (step S150), the first compensation control part 321 calculates a compensation data Db(n) of the image data d(n) using a compensation data Fm+1 of the (n−1)-th frame and the compensation data Fm corresponding to the m-th set temperature value Tm smaller than and closest to the temperature value t(n) using a linear interpolation method (step S151). The compensation data Db(n) may be calculated using a linear interpolation method as following Equation 2.

$$\frac{(F_{m+1}-F_m)}{(T_{m+1}-\Delta t-T_m)}=\frac{F_{m+1}-Db(n)}{T_{m+1}-\Delta t-t(n)} \quad \text{⟨Equation 2⟩}$$

$$Db(n)=F_{m+1}-\frac{T_{m+1}-\Delta t-t(n)}{T_{m+1}-\Delta t-T_m}(F_{m+1}-F_m)$$

The compensation data D(n) of the image data d(n) may be employed to generate the compensation data Da(n) when a temperature value t(n) of a current frame is greater than a temperature value t(n−1) of a previous frame, and may be employed to generate the compensation data Db(n) when the temperature value t(n) of a current frame is smaller than the temperature value t(n−1) of the previous frame. As a result, when the temperature value t(n) of a current frame increases or decreases, the compensation data D(n) of the current frame may be generated using the compensation data Da(n) or the compensation data Db(n), respectively.

Thus, when a minute temperature variation gradually decreases or increases at a boundary area between an m-th set temperature value Tm and an (m+1)-th set temperature value Tm+1 in accordance with time, a variation of the compensation data may be compensated with respect to a compensation data of a previous frame.

Hereinafter, the same reference numerals will be used to designate same components as those described in the previous exemplary embodiments, and thus any repetitive detailed description concerning the same elements may be omitted for convenience.

Figure 5:
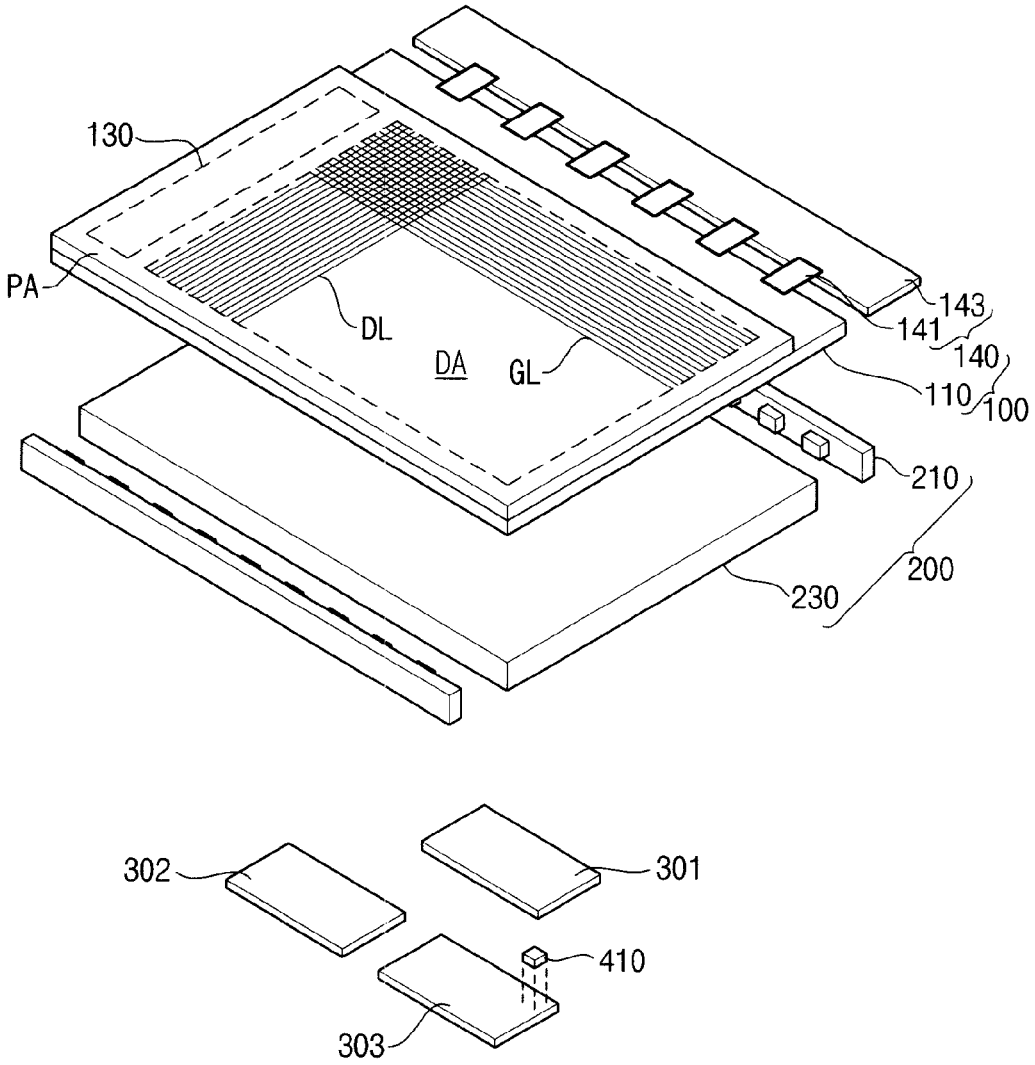
FIG. 5 is a perspective view illustrating another exemplary embodiment of a display apparatus according to the present invention.

FIG. 5 is a perspective view illustrating another exemplary embodiment of the present invention.

Referring to FIG. 5, an exemplary embodiment of the display apparatus includes a panel assembly 100, a light source assembly 200 and circuit boards 301, 302 and 303.

The panel assembly 100 includes a display panel 110 and a data driving part 140. The display panel 110 includes a display area DA in which a plurality of pixels is formed and a peripheral area PA surrounding the display area DA. A gate driving part 130 which generates a gate signal to be provided to the gate line GL is formed at the peripheral area PA of the display panel 110. In one exemplary embodiment, the gate driving part 130 may include a plurality of circuit transistors, and the plurality of circuit transistors may be formed through a substantially same process with a forming process of the pixel transistor. In another exemplary embodiment, the gate driving part 130 may be connected to the display panel 110 through the TCP method in which the gate driving chip is mounted thereon. In still another exemplary embodiment, the gate driving part 130 may be mounted on the peripheral area PA of the display panel 110 through the COG method in which the gate driving chip is directly mounted on the peripheral area PA.

The data driving part 140 includes a TCP 141 in which a data driving chip generating a data signal provided to the data line DL is mounted, and a printed circuit board ("PCB") 143 for connecting the TCP 141 and the circuit boards 301, 302 and 303. The data driving part 140 may be mounted on the peripheral area PA of the display panel 110 through the COG method in which the data driving chip is directly mounted on the peripheral area PA.

The light source assembly 200 is disposed below the display panel 110 to provide the display panel 110 with light. The light source assembly 200 includes a light source unit 210 generating light and a light guide plate 230 guiding the light from the light source assembly 210 toward the display panel 110. The light source unit 210 includes a light source generating light. The light source may be a lamp, a light-emitting diode, or other materials providing light, for example. The light source units 210 are disposed at two end portions of the display panel 110, which are opposite to each other. In one exemplary embodiment, the light source unit 210 may be disposed at a surface corresponding to a display area DA of the display panel 110 in a direct type structure of a backlight assembly. In the direct type structure, the light guide plate 230 may be omitted.

The circuit boards 301, 302 and 303 are disposed at a rear surface of the light source assembly 200. The circuit boards 301, 302 and 303 may be attached at a rear surface of a receiving container receiving the light source assembly 200. In one exemplary embodiment, the circuit boards 301, 302 and 303 may include a driving circuit board 301 generating driving signals provided to the gate driving part 130 and the data driving part 140, a light source driving circuit board 302 generating a driving signal for driving the light source unit 210, and an image circuit board 303 processing an image signal received from an external device (not shown) into a two-dimensional ("2D") image or a three-dimensional ("3D"') image, for example. The image circuit board 303 may include a temperature sensor 410.

In one exemplary embodiment, when the display apparatus is used in a television set, the temperature sensor 410 may be mounted on the image circuit board 303, for example. Moreover, when the display apparatus is used in an LCD module, the temperature sensor 410 may be mounted on the display panel 110 or the driving circuit board 301. When the temperature sensor 410 is mounted on the image circuit board 303 or the driving circuit board 310, the temperature sensor 410 may be a form of a chip. Alternatively, when the temperature sensor 410 is mounted on the display panel 110, the temperature sensor 410 may be formed on a peripheral area PA of the display panel 110 in a manufacturing process substantially identical to a manufacturing process of the pixel transistor TR formed on the display area DA.

The circuit boards 301, 302 and 303, which are disposed at a rear surface of the light source assembly 200, are resultantly disposed at a rear surface of the display panel 110. A driving temperature of the circuit boards 301, 302 and 303, a temperature of a first area of the display panel 110 on which the circuit boards 301, 302 and 303 are disposed is greater than a temperature of a second area of the display panel 110 on which the circuit boards 301, 302 and 303 are not disposed. A response speed of liquid crystal molecules of the display panel 110 is varied in accordance with temperature. That is, a liquid crystal response speed of the first area where the circuit boards 301, 302 and 303 are disposed is different from a liquid crystal response speed of the second area where the circuit boards 301, 302 and 303 are not disposed.

Therefore, in view of liquid crystal property corresponding to a spatial temperature distribution of the display panel 110, the driving circuit board 301 may include a data compensating part generating a compensation data for compensating an image in accordance with the spatial temperature distribution of the display panel 110.

Figure 6:
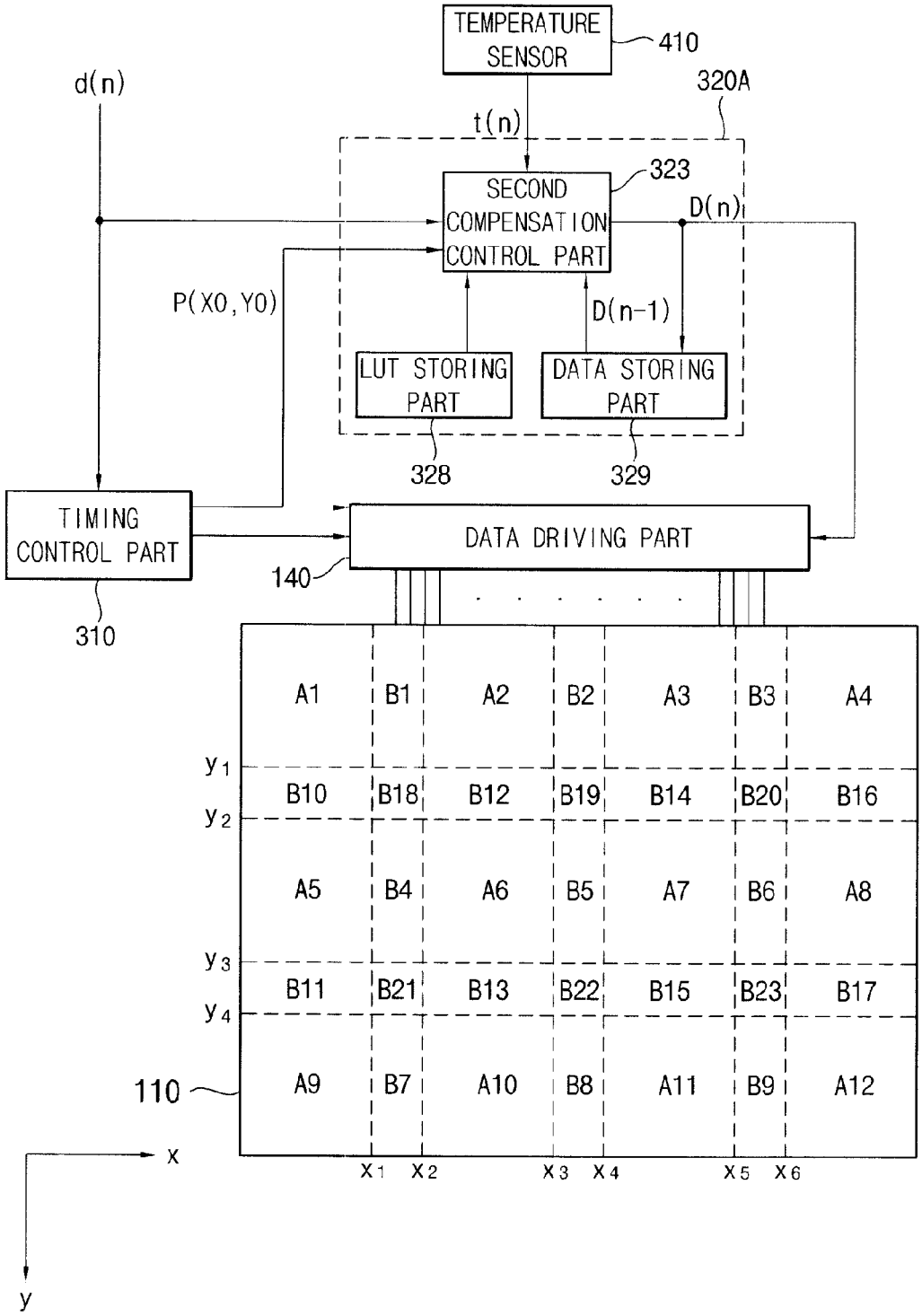
FIG. 6 is a block diagram showing an exemplary embodiment of the display apparatus of FIG. 5.

FIG. 6 is a block diagram showing an exemplary embodiment of the display apparatus as shown in FIG. 5.

Referring to FIGS. 5 and 6, the display apparatus includes a timing control part 310, a data compensating part 320A, the data driving part 140 and the display panel 110.

The timing control part 310 receives an image data d(n) to provide the data compensating part 320A with an position data p(x0,y0) of the image data d(n).

The data compensating part 320A includes a second compensation control part 323, an LUT storing part 328 and a data storing part 329 to generate a compensation data D(n) of the image data d(n) in accordance with positions of the display panel 110 using the image data d(n) and the position data p(x0,y0).

For example, the display panel 110 may be divided into a plurality of space areas and a plurality of boundary areas of between the space areas by a plurality of parameters. In one exemplary embodiment, due to six x parameters x1, x2, x3, x4, x5 and x6 along x-axis and four y parameters, the display panel 110 may be divided into twelve space areas A1, A2, A3, . . . , A12 and twenty-three boundary areas B1, B2, B3, . . . , B23 positioned between the space areas A1, A2, A3, . . . , A12, for example. In this case, the x parameters and y parameters may be user setting values stored as a register value, for example, and may be set in various ways in accordance with the number of the space areas.

The second compensation control part 323 receives a temperature value t(n), an image data d(n) and the position data p(x0,y0) of the image data d(n).

The second compensation control part 323 determines a set temperature value T corresponding to the temperature value t(n). The second compensation control part 323 reads a plurality of LUTs from the LUT storing part 328, which are mapped corresponding to the space areas A1, A2, A3, . . . , A12 using the image data d(n), the position data p(x0,y0) and the set temperature value T. The second compensation control part 323 generates the compensation data D(n) of the image data d(n) positioned at the space areas A1, A2, A3, . . . , A12 using the LUTs corresponding to the set temperature value T(n).

The second compensation control part 323 generates an image data d(n) positioned at the boundary areas B1, B2, B3, . . . , B23 using a compensation data D(n) positioned at space areas A1, A2, A3, . . . , A12 adjacent to the boundary areas B1, B2, B3, . . . , B23 using a linear interpolation method. Thus, the compensation data D(n) of the image data d(n) positioned at the boundary areas B1, B2, B3, . . . , B23 may be generated to be data which are gradually varied with respect to the compensation data D(n) positioned at the adjacent space areas A1, A2, A3, . . . , A12.

The LUT storing part 328 stores a plurality of look-up tables LUT1, . . . , LUTm, LUTm+1, . . . , LUTk mapped corresponding to a plurality of set temperature values T1, . . . , Tm, Tm+1, . . . , Tk, as shown in a manner of FIG. 2. In this case, 'm' and 'k' are natural numbers.

The following Equation 3 is an example showing LUT information (also referred to as "Local DCC") mapped corresponding to a space area.

$$\text{Local DCC}(T)=(LUT_{A1}),(LUT_{A2}),(LUT_{A3}),\ldots,(LUT_{A12}) \quad \text{<Equation 3>}$$

Referring to Equation 3, in the Local DCC, a first look-up table LUTA1 is mapped corresponding to a first space area A1, a second look-up table LUTA2 is mapped corresponding to a second space area A2, and a third look-up table LUTA3 is mapped corresponding to a third space area A3 in accordance with the set temperature value T. Similarly to the manner, a twelfth look-up table LUTA12 is mapped corresponding to a twelfth space area A12 in accordance with the set temperature value T.

The Local DCC may be stored in a register, and the second compensation control part 323 may use LUTs mapped corresponding to set temperature values which are stored in the LUT storing part 328 using the Local DCC.

In one exemplary embodiment, the LUT storing part 328 may store LUTs mapped corresponding to the space areas in accordance with a set temperature value T as shown in Equation 3.

The data storing part 329 stores a compensation data D(n) generated for the second compensation control part 323. When an image data d(n+1) of a next frame (that is, an (n+1)-th frame) is compensated using the compensation data D(n) stored in the data storing part 329, the second compensation control part 323 may use a compensation data of the n-th frame.

Figure 7:
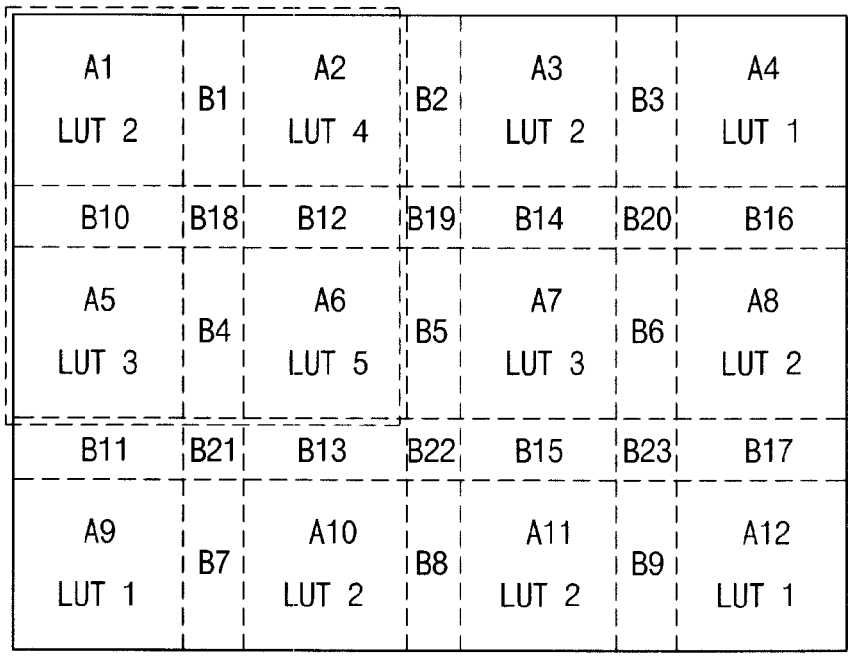
FIG. 7 is a concept diagram showing an exemplary embodiment of an LUT mapped corresponding to a space area of a display panel of FIG. 6.

FIG. 7 is a concept diagram showing the exemplary embodiment of the look-up table mapped corresponding to a space area of a display panel as shown in FIG. 6.

Referring to FIG. 7, when the temperature value t(n) is about 10 Celsius (° C.), the compensation control part 323 reads a set temperature value T stored in the LUT storing part 329 and twelve look-up tables LUT2, LUT4, LUT2, LUT, LUT3, LUT5, LUT3, LUT2, LUT, LUT2, LUT2 and LUT for twelve space areas A1, A2, A3, . . . , A12 mapped at a temperature of about 10° C. The second compensation control part 323 generates the compensation data D(n) of the image data d(n) using twelve look-up tables LUT2, LUT4, LUT2, LUT1, LUT3, LUT5, LUT3, LUT2, LUT1, LUT2, LUT2 and LUT1 mapped corresponding to the space areas A1, A2, A3, . . . , A12. In addition, the second compensation control part 323 generates a compensation data D(n) of an image data d(n) positioned at the boundary areas B1, B2, B3, . . . , B23 using a linear interpolation method with the compensation data D(n) of the image data d(n) positioned at adjacent space areas A1, A2, A3, . . . , A12.

Figure 8A:
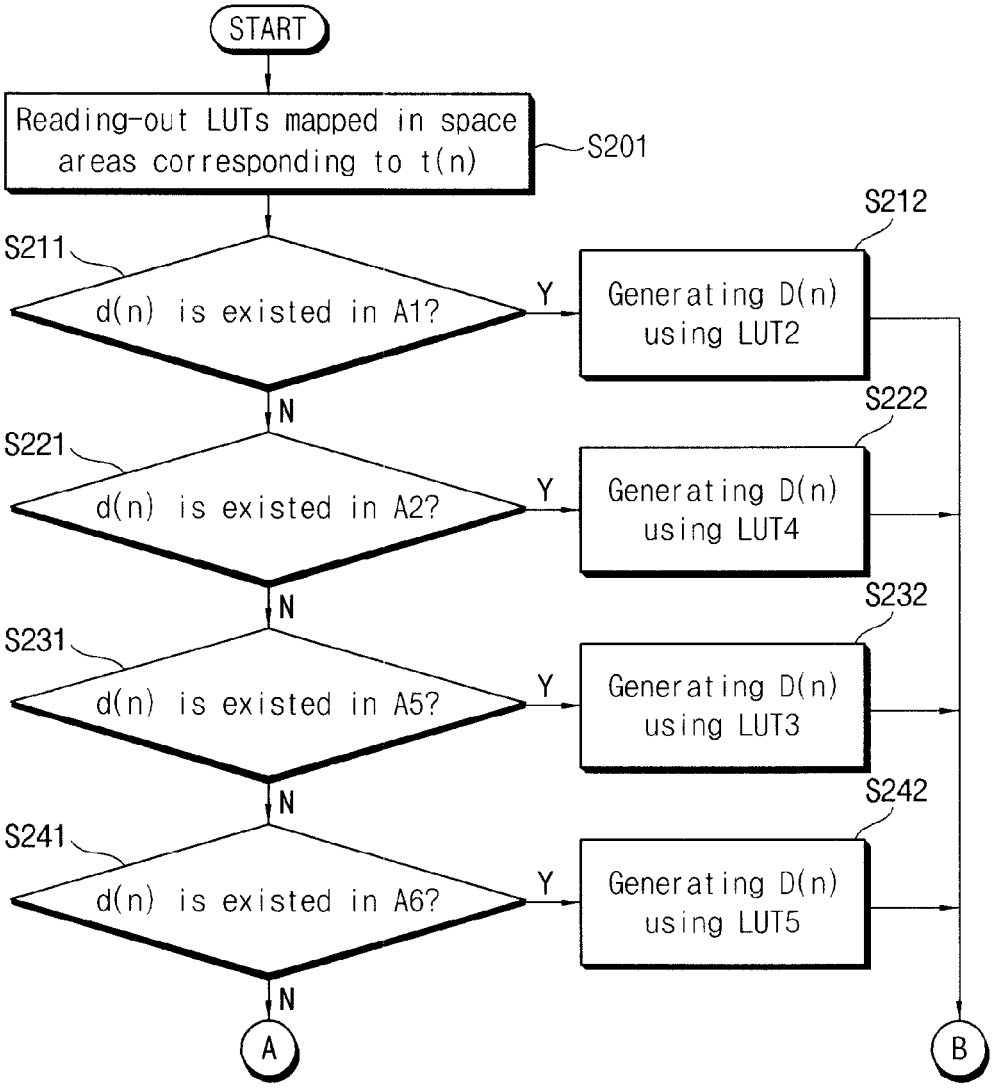
FIGS. 8A and 8B are flowcharts showing an exemplary embodiment of an interpolation method in which a compensation data is generated by a data compensating part of FIG. 6.
Figure 8B:
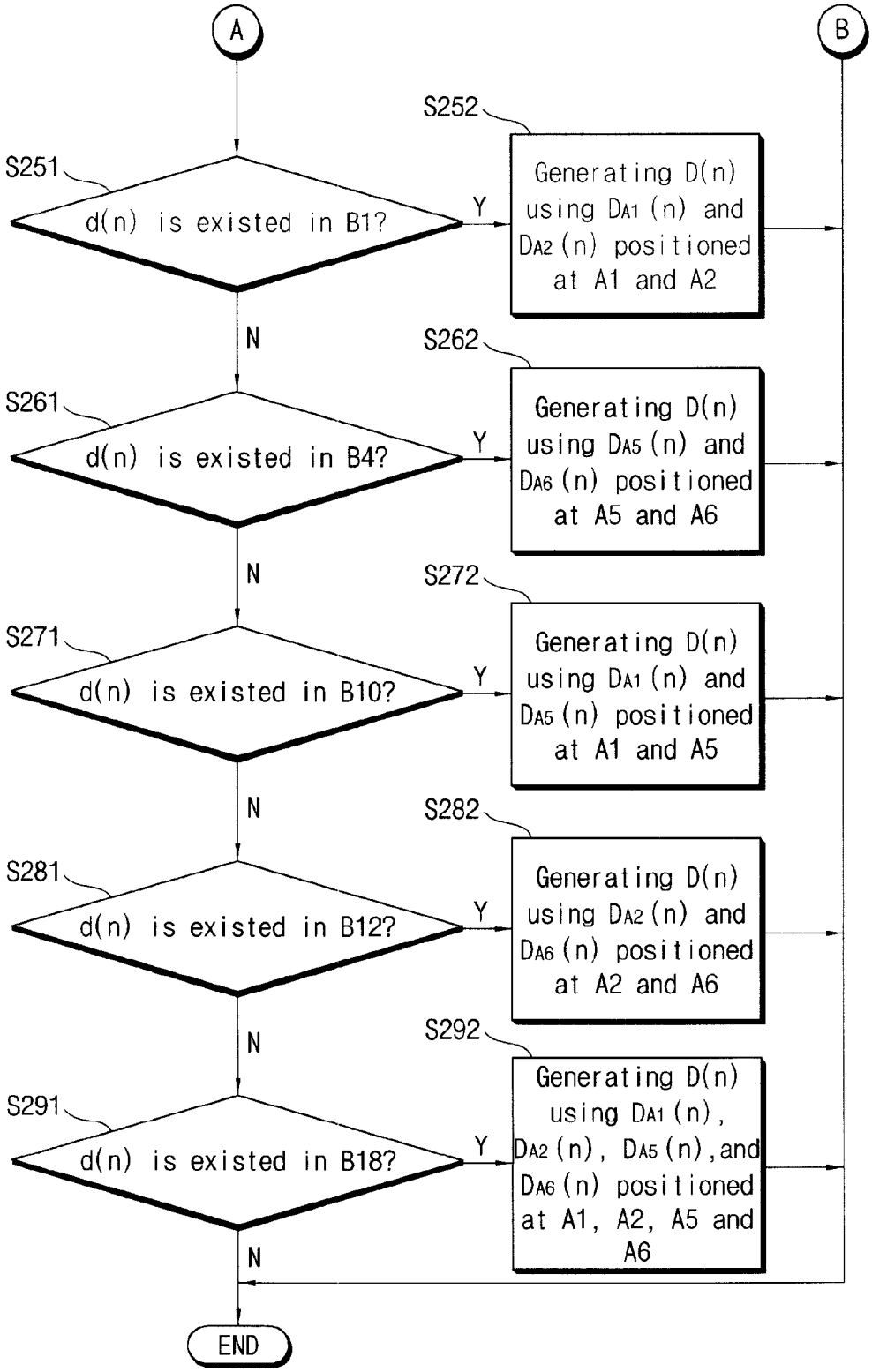
Figure 9A:
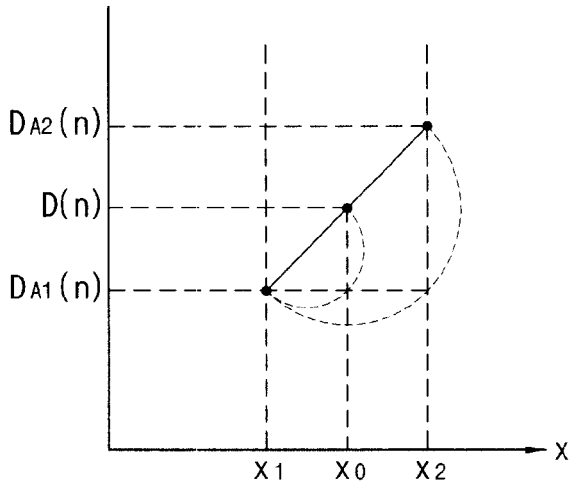
FIGS. 9A, 9B, 9C and 9D are concept diagrams showing an exemplary embodiment of an interpolation method generating a compensation data of an image data positioned at first, fourth, tenth and twelfth boundary areas of FIG. 7.
Figure 9B:
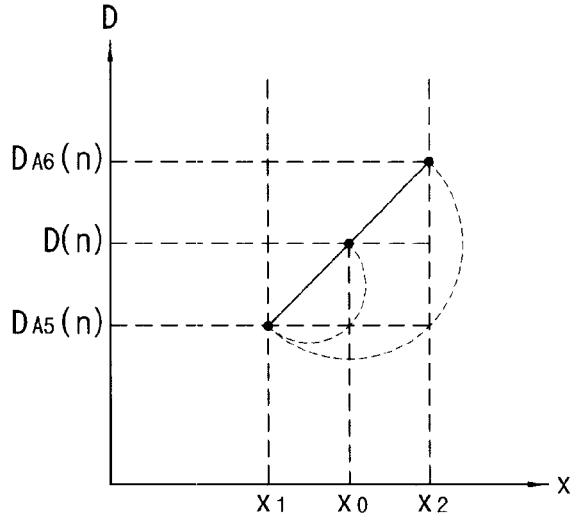
Figure 9C:
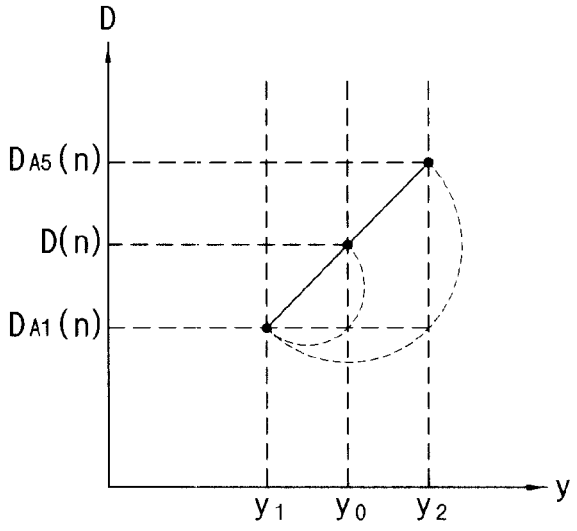
Figure 9D:
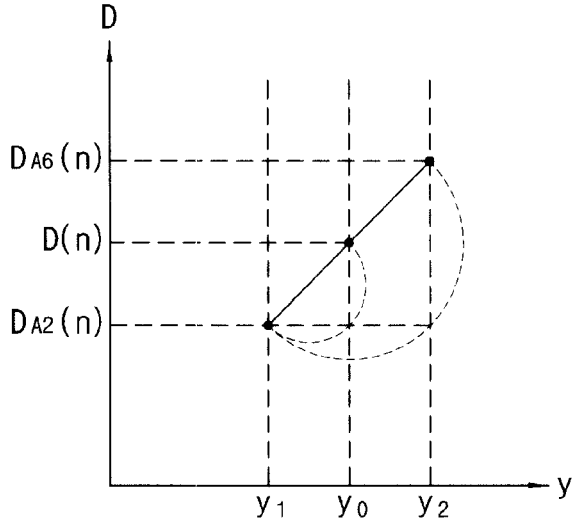
Figure 10A:
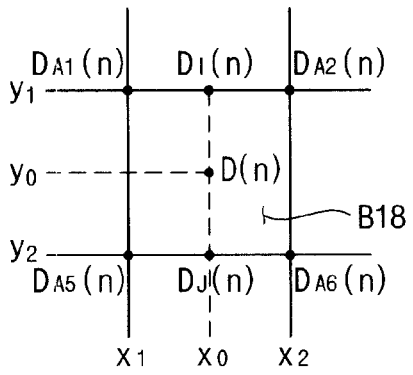
FIGS. 10A, 10B, 10C and 10D are concept diagrams showing an exemplary embodiment of an interpolation method generating a compensation data of an image data positioned at an eighteenth boundary area of FIG. 7.
Figure 10B:
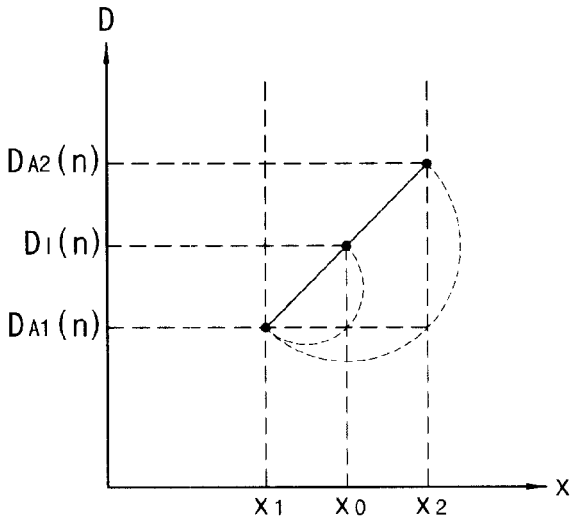
Figure 10C:
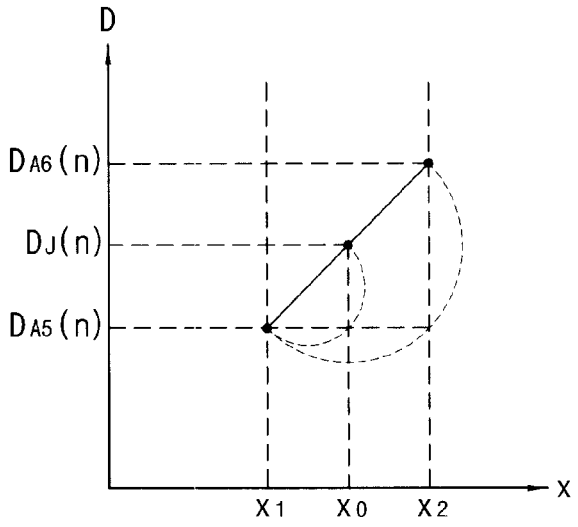
Figure 10D:
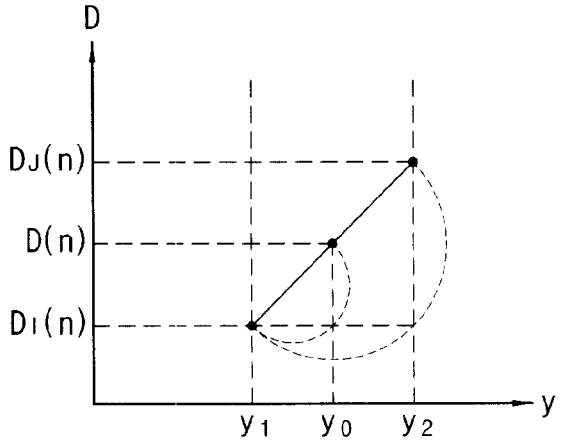

FIGS. 8A and 8B are flowcharts showing an exemplary embodiment of an interpolation method in which a compensation data is generated by a data compensating part as shown in FIG. 6. FIGS. 9A, 9B, 9C and 9D are concept diagrams showing the exemplary embodiment of an interpolation method generating a compensation data of an image data positioned at first, fourth, tenth and twelfth boundary areas, respectively, as shown in FIG. 7. FIGS. 10A, 10B, 10C and 10D are concept diagrams showing an interpolation method generating a compensation data of an image data positioned at an eighteenth boundary area as shown in FIG. 7.

Hereinafter, a process in which a compensation data D(n) of an image data d(n) positioned at first, second, fifth and sixth space areas A1, A2, A5 and A6 among twelve space areas A1 to A12 is generated will be explained. The number of the space areas and the boundary areas may be variously set.

Referring to FIGS. 6, 7 and 8A, the second compensation control part 323 receives a temperature value t(n), an image data d(n) and the position data p(x0,y0) of the image data d(n). The second compensation control part 323 reads look-up tables LUT2, LUT4, LUT2, LUT, LUT3, LUT5, LUT3, LUT2, LUT, LUT2, LUT2 and LUT mapped corresponding to the space areas A1 to A12 with respect to the set temperature value T(n) corresponding to the temperature value t(n) (step S201).

When the position data p(x0,y0) is positioned at the second space area A1 (x0≤x1 and y0≤y1) (step S211), the second compensation control part 323 generates the compensation data D(n) using a second look-up table LUT2 mapped corresponding to the first space area A1 (step S212).

When the position data p(x0,y0) is positioned at the second space area A2 (x0≥x2 and y0≤y1) (step S221), the second compensation control part 323 generates the compensation data D(n) using a fourth look-up table LUT4 mapped corresponding to the second space area A2 (step S222).

When the position data p(x0,y0) is positioned at the fifth space area A5 (x0≤x1 and y0≥y2) (step S231), the second compensation control part 323 generates the compensation data D(n) using a third look-up table LUT3 mapped corresponding to the fifth space area A5 (step S232).

When the position data p(x0,y0) is positioned at the sixth space area A6 (x0≥x2 and y0≥y2) (step S241), the second compensation control part 323 generates the compensation data D(n) using a fifth look-up table LUT5 mapped corresponding to the sixth space area A6 (step S242).

Using a similar method, the second compensation control part 323 generates compensation data D(n) of image data d(n) positioned at other remaining space areas.

Referring to FIGS. 6, 7, 8B and 9A, when it is determined that the image data d(n) is positioned at a first boundary area B1 between the first and second space areas A1 and A2 (step S251), the second compensation control part 323 generates a compensation data D(n) of the image data d(n) positioned at the first boundary area B1 using a compensation data DA1(n) of an image data positioned at a first space area A1 and a compensation data DA2(n) of an image data positioned at a second space area A2 using a linear interpolation method (step S252).

That is, when the position data p(x0,y0) is positioned at the first boundary area B1 (i.e., x1<x0<x2 and y0≤y1), the second compensation control part 323 may calculate the compensation data D(n) of the image data d(n) using a linear interpolation method such as the following Equation 4.

$$\frac{(x0-x1)}{(x2-x1)} = \frac{D(n)-D_{A1}(n))}{D_{A2}(n)-D_{A1}(n)} \qquad \text{⟨Equation 4⟩}$$

$$D(n) = D_{A1}(n) + \frac{(x0-x1)}{(x2-x1)}(D_{A2}(n)-D_{A1}(n))$$

In this case, the compensation data DA1(n) is generated by a second look-up table LUT2, and the compensation data DA2(n) is generated by a fourth look-up table LUT4.

Referring to FIGS. 6, 7, 8B and 9B, when the position data p(x0,y0) is positioned at a fourth boundary area B4 (i.e., x1<x0<x2 and y0≥y2) (step S261), the second compensation control part 323 may calculate a compensation data D(n) of the image data d(n) using the compensation data DA5(n) of the image data positioned at the fifth space area A5 and the compensation data DA6(n) of the image data positioned at the sixth space area A6 using a linear interpolation method such as the following Equation 5 (step S262).

$$D(n) = D_{A5}(n) + \frac{(x0-x1)}{(x2-x1)}(D_{A6}(n)-D_{A5}(n)) \qquad \text{⟨Equation 5⟩}$$

In this case, the compensation data DA5(n) is generated by a third look-up table LUT3, and the compensation data DA6(n) is generated by a fifth look-up table LUT5.

Referring to FIGS. 6, 7, 8B and 9C, when the position data p(x0,y0) is positioned at a tenth boundary area B10 (i.e., x0≤x1 and y1<y0<y2) (step S271), the second compensation control part 323 may calculate a compensation data D(n) of the image data d(n) using the compensation data DA1(n) of the image data positioned at the first space area A1 and the compensation data DA5(n) of the image data positioned at the fifth space area A5 using a linear interpolation method such as the following Equation 6 (step S272).

$$D(n) = D_{A1}(n) + \frac{(y0-y1)}{(y2-y1)}(D_{A5}(n)-D_{A1}(n)) \qquad \text{⟨Equation 6⟩}$$

In this case, the compensation data DA1(n) is generated by a second look-up table LUT2, and the compensation data DA5(n) is generated by a third look-up table LUT3.

Referring to FIGS. 6, 7, 8B and 9D, when the position data p(x0,y0) is positioned at a twelfth boundary area B12 (i.e., x0≥x1 and y1<y0<y2) (step S281), the second compensation control part 323 may calculate a compensation data D(n) of the image data d(n) using the compensation data DA2(n) of the image data positioned at the second space area A2 and the compensation data DA6(n) of the image data positioned at the sixth space area A6 using a linear interpolation method such as the following Equation 7 (step S282).

$$D(n) = D_{A2}(n) + \frac{(y0 - y1)}{(y2 - y1)}(D_{A6}(n) - D_{A2}(n)) \quad \text{⟨Equation 7⟩}$$

In this case, the compensation data DA2(n) is generated by a fourth look-up table LUT4 and the compensation data DA6 (n) is generated by a fifth look-up table LUT 5.

Accordingly, when the image data d(n) is positioned between two space areas in which the boundary areas are adjacent to each other along one direction (i.e., x-axis direction or y-axis direction), the second compensation control part 323 may calculate a compensation data of an image data positioned at the boundary area using a linear interpolation method with two compensation data corresponding to the two space areas.

Referring to FIGS. 6, 7, 8B and 10A, when the position data p(x0,y0) is positioned at a eighteenth boundary area B18 (i.e., x1<x0<x2 and y1<y0<y2) (step S291), the second compensation control part 323 may calculate a compensation data D(n) of the image data d(n) using a compensation data DA1 (n) of the image data positioned at the first space area A1, a compensation data DA2(n) of the image data positioned at the second space area A2, a compensation data DA5(n) of the image data positioned at the fifth space area A5, and the compensation data DA6(n) of the image data positioned at the sixth space area A6 using a linear interpolation method (step S292).

Referring to FIGS. 6, 7, 8B, 10A and 10B, the second compensation control part 323 may calculate a compensation data DI(n) when the position data is y0≤y1 using the compensation data DA1(n) of the image data positioned at the first space area A1 and the compensation data DA2(n) of the image data positioned at the second space area A2 using a linear interpolation method such as the following Equation 8.

$$D_I(n) = D_{A1}(n) + \frac{(x0 - x1)}{(x2 - x1)}(D_{A2}(n) - D_{A1}(n)) \quad \text{⟨Equation 8⟩}$$

Referring to FIGS. 6, 7, 8B, 10A and 10C, the second compensation control part 323 may calculate a compensation data DJ(n) when the position data is y2≤y0≤y3 using the compensation data DA5(n) of the image data positioned at the fifth space area A5 and the compensation data DA6(n) of the image data positioned at the sixth space area A6 using a linear interpolation method such as the following Equation 9.

$$D_J(n) = D_{A5}(n) + \frac{(x0 - x1)}{(x2 - x1)}(D_{A6}(n) - D_{A5}(n)) \quad \text{⟨Equation 9⟩}$$

Referring to FIGS. 6, 7, 8B, 10A and 10D, the second compensation control part 323 may calculate a compensation data D(n) of the image data d(n) using the compensation data DI(n) and the compensation data DJ(n) using a linear interpolation method such as the following Equation 10.

⟨Equation 10⟩

$$\begin{aligned} D(n) &= D_I(n) + \frac{(y0 - y1)}{(y2 - y1)}(D_J(n) - D_I(n)) \\ &= D_{A1}(n) + \frac{(x0 - x1)}{(x2 - x1)}(D_{A2}(n) - D_{A1}(n)) + \\ &\quad \frac{(y0 - y1)}{(y2 - y1)}(D_{A5}(n) - D_{A1}(n)) + \\ &\quad \frac{(x0 - x1)(y0 - y1)}{(x2 - x1)(y2 - y1)}(D_{A1}(n) + D_{A6}(n) - D_{A2}(n) - D_{A5}(n)) \end{aligned}$$

Accordingly, when the image data d(n) is positioned at a boundary area of four space areas, the second compensation control part 323 may calculate a compensation data D(n) of the image data d(n) using a linear interpolation method with four compensation data corresponding to the four space areas.

Using a similar method, the second compensation control part 323 may generate compensation data of the image data, when the image data are positioned at twelve space areas and twenty-three boundary areas.

According to the present exemplary embodiment, compensation data of an image data are generated in accordance with a temperature distribution corresponding to a position of the display panel 110, so that display defects due to a temperature deviation of the display panel 110 may be substantially prevented.

Hereinafter, the same reference numerals will be used to designate the same components as those described in the previous exemplary embodiment, and thus any repetitive detailed description concerning the same elements may be omitted for convenience.

Figure 11:
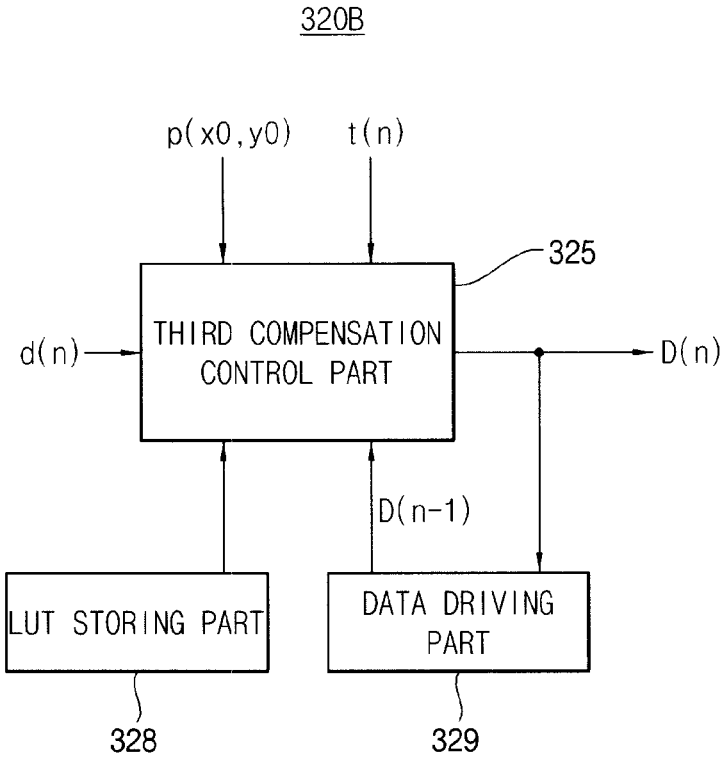
FIG. 11 is a block diagram showing another exemplary embodiment of the data compensating part of FIG. 6 according to the present invention.
Figure 12:
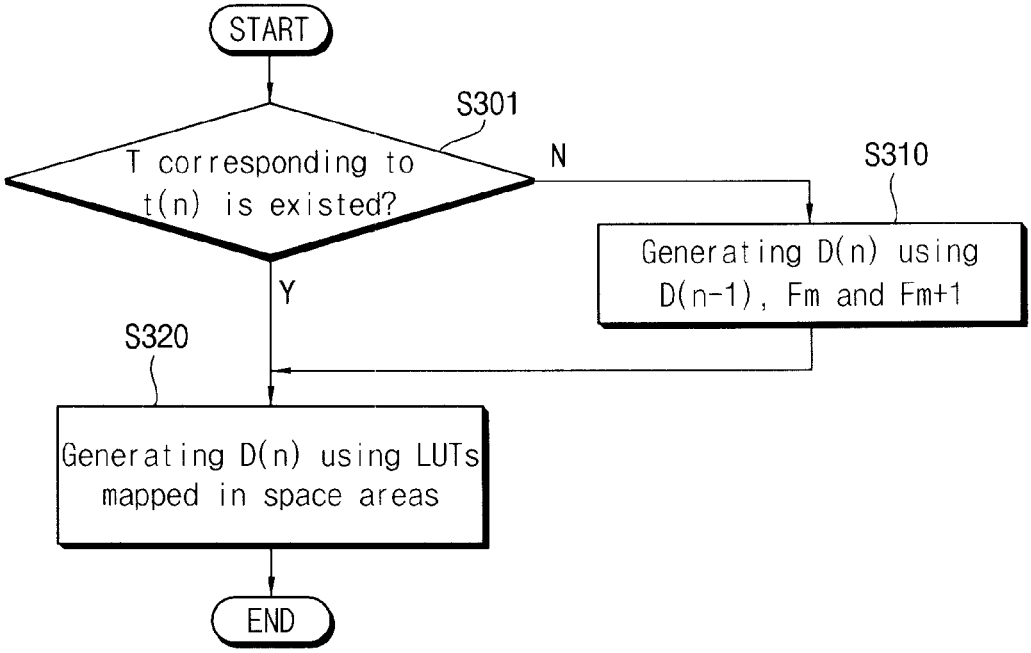
FIG. 12 is a flowchart showing an exemplary embodiment of a method of generating a compensation data by the data compensating part of FIG. 11.

FIG. 11 is a block diagram showing another exemplary embodiment of a data compensating part according to the present invention. FIG. 12 is a flowchart showing an exemplary embodiment of a method of generating a compensation data by the data compensating part of FIG. 11.

Referring to FIGS. 6, 11 and 12, an exemplary embodiment of the display apparatus includes a data compensating part 320B.

The data compensating part 320B includes a third compensation control part 325, an LUT storing part 328 and a data storing part 329.

The third compensation control part 325 receives an image data d(n) of a current frame, a position data p(x0,y0) of the image data d(n) and a temperature value t(n).

The third compensation control part 325 adaptively generates a compensation data D(n) of the image data d(n) to a fine temperature variation according to a time and a temperature variation according to a position of the display panel 110, using the image data d(n), the position data p(x0,y0) and the temperature value t(n).

A detailed process in which the data compensation part 320B generates the compensation data will be hereinafter explained.

The third compensation control part 325 checks whether or not the temperature value t(n) exists in plural set temperature values T1, . . . , Tm, Tm+1, . . . , Tk (step S301).

When it is determined that the temperature values t(n) exists in the set temperature values T1, . . . , Tm, Tm+1, . . . , Tk, the third compensation control part 325 generates the compensation data D(n) using plural look-up tables mapped corresponding to a plurality of space areas A1, A2, A3, . . . , A12 which are set to a set temperature values T corresponding to the temperature value t(n) in a method explained FIGS. 8A and 8B (step S320).

When it is determined that the temperature values t(n) does not exist in the set temperature values T1, . . . , Tm, Tm+1, . . . , Tk, the third compensation control part 325 generates a compensation data D(n) using an (n−1)-th frame data D(n−1) stored in the data storing part 329, a compensation data Fm generated based on an m-th set temperature value Tm smaller and closest to the temperature value t(n), and a compensation data Fm+1 generated based on an (m+1)-th set temperature value Tm+1 greater than and closest to the temperature value t(n) (step S310).

A process generating a compensation data D(n) of an image data d(n) positioned at the first space area A1 will be hereinafter explained. In one exemplary embodiment, a first look-up table LUT1 is mapped at an m-th set temperature value Tm and a second look-up table LUT2 is mapped at an (m+1)-th set temperature value Tm+1, with respect to a first space area A1 of FIG. 6.

When a temperature value t(n) exists between an m-th set temperature value Tm and a first permissive temperature value (Tm+Δt) and an (n−1)-th frame data D(n−1) stored in the data storing part 329 is generated through the first look-up table LUT1 of the m-th set temperature value Tm, the third compensation control part 325 generates an (n−1)-th frame data D(n−1) stored on the data storing part 329 to be a compensation data D(n) of the image data d(n) (step S120 and step S121 of FIG. 3).

Then, when the temperature value t(n) exists between the first permissive temperature value (Tm+Δt) and an (m+1)-th set temperature value Tm+1 and an (n−1)-th frame data D(n−1) stored in the data storing part 329 is generated through the first look-up table LUT1 of the m-th set temperature value Tm, the third compensation control part 325 generates the compensation data D(n) using a linear interpolation method with a compensation data generated through an (n−1)-th frame data D(n−1) and a second look-up table LUT2 of the (m+1)-th set temperature value Tm+1 (step S140 and step S141 of FIG. 3).

Then, when the temperature value t(n) exists between the second permissive temperature value (Tm+Δt) and an (m+1)-th set temperature value Tm+1 and an (n−1)-th frame data D(n−1) stored in the data storing part 329 is generated through the second look-up table LUT2 of the (m+1)-th set temperature value Tm+1, the third compensation control part 325 generates the (n−1)-th frame data D(n−1) stored in the data storing part 329 to be a compensation data D(n) of the image data d(n) (step S130 and step S131 of FIG. 3).

Then, when the temperature value t(n) exists between the first set temperature value Tm and the second permissive temperature value (Tm+Δt) and an (n−1)-th frame data D(n−1) stored in the data storing part 329 is generated through the second look-up table LUT2 of the (m+1)-th set temperature value Tm+1, the third compensation control part 325 generates the compensation data D(n) using a linear interpolation method with a compensation data generated through an (n−1)-th frame data D(n−1) and a compensation data generated through a first look-up table LUT1 of the m-th set temperature value Tm (step S150 and step S151 of FIG. 3).

Using a similar method, compensation data D(n) of image data d(n) positioned at one of the space areas or the boundary areas of the display panel 110 of FIG. 6 is generated.

In the present exemplary embodiment, a compensation data is generated in accordance with a temperature by a position of the display panel 110, so that display defects according to a temperature deviation of the display panel 110 may be substantially prevented. Moreover, a linear interpolation method is adapted at a boundary area of the space areas in which two look-up tables are employed, so that display defects which are viewed due to crosstalk that is suddenly generated may be substantially prevented.

Moreover, when a minute temperature variation gradually decreases or increases at a boundary area between an m-th set temperature value Tm and an (m+1)-th set temperature value Tm+1 in accordance with time, a variation of the compensation data may be gradually compensated with respect to a compensation data of a previous frame.

The foregoing is illustrative of the present invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed:

1. A method of displaying an image on a display apparatus, the display apparatus comprising a display panel, a temperature sensor detecting a temperature of a portion of the display panel, a data driving part outputting a data signal to the display panel, and a data compensation part adjusting the data signal according to the detected temperature, and the method comprising:

storing a plurality of set temperature values in the data compensation part;

detecting the temperature of the portion of the display panel in a first frame;

comparing the detected temperature to the set temperature values to determine a temperature range to which the detected temperature belongs among the set temperature values; and adjusting the data signal according to the temperature range to generate a compensated data signal in a second frame subsequent to the first frame, wherein one of a plurality of the boundary values of the temperature range is defined by a temperature value greater than or lower than one of the set temperature values by a permissive temperature value wherein the compensated data signal in the second frame is substantially the same as the data signal in the first frame if a difference between the detected temperature and the one of the set temperature values is lower than the permissive temperature value.

2. The method of claim 1, wherein one of the plurality of boundary values of the temperature range is defined by one of the set temperature values.

3. The method of claim 1, wherein the compensated data signal in the second frame is linearly interpolated by the data signal in the first frame and an adjacent data signal if a difference between the detected temperature and the one of the set temperature values is greater than the permissive temperature value, wherein the data signal in the first frame is generated by using a first look-up table mapping to a first set temperature value and the adjacent data signal is generated by using a second look-up table mapping to the most adjacent set temperature value to the first set temperature value.

4. A method of displaying an image on a display apparatus, the display apparatus comprising a display panel, a temperature sensor detects a temperature of a portion of the display panel, a data driving part outputs a data signal to the display panel, and a data compensation part adjusts the data signal based on the detected temperature, wherein the display panel comprising a plurality of space areas having a first space area different from a second space area, and the method comprising:

storing a plurality of set temperature values in the data compensation part;

detecting the temperature of the first space area and the second space area to determine the set temperature value; and generating a first compensated data signal and a second compensated data signal configured to be output to the first space area and the second space area, wherein the first compensated data signal is different from the second compensated data signal if the temperature of the first space area is different from the temperature of the second space area, wherein the boundary area is located between the first space area and the second space area in a latitudinal, longitudinal, or diagonal direction, wherein the generating the third compensated data signal comprising:

linearly interpolating the first compensated data signal of the first space area and the second space area to generate the third compensated data signal if the boundary area is located between the first space area and the second space area in a latitudinal or longitudinal direction.

5. The method of claim 4 further comprising:

storing a plurality of look-up tables in the data compensation part, wherein the look-up tables comprises a first look-up table which maps to the first space area and a second look-up table which maps to the second space area, and wherein the first compensated data signal and the second compensated data signal are generated using the first look-up table and the second look-up table, respectively.

6. The method of claim 4, wherein the display panel further comprises a boundary area between the first space area and the second space area, and the method further comprising:

generating a third compensated data signal outputted to the boundary area using the first compensated data signal and the second compensated data signal.

7. The method of claim 4, wherein the boundary area is adjacent to the first space area, the second space area, a third space area and a fourth space area in a diagonal direction, wherein a fourth compensated data signal and a fifth compensated data signal are outputted to the third space area and the fourth space area, respectively, and wherein the generating the third compensated data comprising:

bilinearly interpolating the first, second, fourth and fifth compensated data signals of the first, second, third and fourth space areas to generate the third compensated data signal.

8. A display apparatus comprising:

a display panel;

a temperature sensor which detects a temperature of a portion of the display panel in a first frame;

a data driving part which outputs a data signal to the display panel; and a data compensation part which adjusts the data signal based on the detected temperature, wherein the data compensation part stores a plurality of set temperature values, compares the detected temperature to the set temperature values to determine a temperature range to which the detected temperature belongs among the set temperature values, and adjusts the data signal based on the temperature range to generate a compensated data signal in a second frame subsequent to the first frame, wherein one of a plurality of boundary values of the temperature range is defined by a temperature value greater than or lower than one of the set temperature values by a permissive temperature value, wherein the compensated data signal in the second frame is substantially the same as the data signal in the first frame if a difference between the detected temperature and the one of the set temperature values is lower than the permissive temperature value.

9. The display apparatus of claim 8, wherein one of a plurality of boundary values of the temperature range is defined by the set temperature values.

10. The display apparatus of claim 8, wherein the compensated data signal in the second frame is linearly interpolated by the data signal in the first frame and an adjacent data signal if a difference between the detected temperature and the one of the set temperature values is greater than the permissive temperature value, wherein the data signal in the first frame is configured to be generated by using a first look-up table mapping to a first set temperature value, and the adjacent data signal is configured to be generated by using a second look-up table mapping to the most adjacent set temperature value to the first set temperature value.

11. A display apparatus comprising:

a display panel comprising a plurality of space areas, the space areas comprising a first space area and a second space area different from the first space area;

a temperature sensor configured to detect temperatures of the first space area and the second space area;

a data driving part configured to output a data signal to the display panel; and a data compensation part configured to store a plurality of set temperature values, wherein the data compensation part is configured to determine a first set temperature value based on the temperatures of the first space area and the second space area, and generate a first compensated data signal and a second compensated data signal configured to be output to the first space area and the second space area, wherein the first compensated data signal is different from the second compensated signal if the temperature of the first space area is different from the temperature of the second space area, wherein the boundary area is disposed between the first space area and the second space area in a latitudinal, longitudinal, or diagonal direction, wherein the data compensation part is configured to linearly interpolate the first compensated data signal of the first space area and the second compensated data signal of the second space area to generate the third compensated data siguaL if the boundary area is disposed between the first space area and the second space area in a latitudinal or longitudinal direction.

12. The display apparatus of claim 11, wherein the data compensation part is further configured to store a plurality of look-up tables comprising a first look-up table and a second look-up table, wherein the first look-up table is configured to map to the first space area and the second look-up table is configured to map to the second space area, and wherein the data compensation part is configured to be generate the first compensated data signal and the second compensated data signal using the first look-up table and the second look-up table respectively.

13. The display apparatus of claim 11, wherein the display panel further comprises a boundary area between the first space area and the second space area, and wherein the data compensation part is configured to generate a third compensated data signal configured to be output to the boundary area using the first look-up table and the second look-up table.

14. The display apparatus of claim 11, wherein the boundary area is adjacent to the first space area, the second space area, a third space area and a fourth space area in a diagonal direction, wherein a fourth compensated data signal and a fifth compensated data signal are configured to be output to the third space area and the fourth space area respectively, and wherein the data compensation part is configured to bilinearly interpolate the first, second, fourth and fifth compensated data signals of the first, second, third and fourth space areas to generate the third compensated data signal.

* * * * *